US007387048B2

(12) United States Patent
Furuta et al.

(10) Patent No.: US 7,387,048 B2
(45) Date of Patent: Jun. 17, 2008

(54) PEDAL DEVICE

(75) Inventors: Hajime Furuta, Aichi (JP); Hiroaki Ogawa, Aichi (JP); Masahiko Murata, Aichi (JP); Junji Hotta, Nagoya (JP); Hideyuki Miyajima, Aichi (JP)

(73) Assignee: Hoshino Gakki Co., Ltd. (JP)

( * ) Notice: Subject to any disclaimer, the term of this patent is extended or adjusted under 35 U.S.C. 154(b) by 794 days.

(21) Appl. No.: 10/869,627

(22) Filed: Jun. 15, 2004

(65) Prior Publication Data

US 2005/0011301 A1 Jan. 20, 2005
US 2005/0183538 A9 Aug. 25, 2005

(30) Foreign Application Priority Data

Jul. 15, 2003 (JP) ..... 2003-197444

(51) Int. Cl.
*G05G 1/14* (2006.01)

(52) U.S. Cl. ..... 74/560

(58) Field of Classification Search ..... 74/512, 74/513, 560, 561, 562; 84/422.1, 422.2, 84/422.3, 353, 225, 229, 746, 721
See application file for complete search history.

(56) References Cited

U.S. PATENT DOCUMENTS 4,653,378 A * 3/1987 Watanabe et al. ..... 84/423 R
5,237,891 A * 8/1993 Lundberg et al. ..... 74/560
6,915,719 B2 * 7/2005 Joo ..... 74/542
7,012,203 B2 * 3/2006 Hanson et al. ..... 200/86.5

FOREIGN PATENT DOCUMENTS

| | | |
|---|---|---|
| JP | 5-38690 | 5/1993 |
| JP | 6-25897 | 4/1994 |
| JP | 7-34489 | 6/1995 |
| JP | 08-202363 | 8/1996 |

OTHER PUBLICATIONS

Japanese Office Action for corresponding Japanese application No. 2003-197444 dated Mar. 20, 2007.

* cited by examiner

*Primary Examiner*—Vicky A Johnson
(74) *Attorney, Agent, or Firm*—Ostrolenk, Faber, Gerb & Soffen, LLP

(57) ABSTRACT

A pedal device including a base and a pedal plate supported by the base in an inclinable manner and depressed by an operator. An urging mechanism urges the pedal plate in a direction opposite to the depression direction of the pedal plate. A force release mechanism releases the pedal plate from an urging force applied by the urging mechanism. A holding mechanism switches the pedal plate between a state in which the pedal plate is held in an operable manner by applying a resistance force resisting operation of the pedal plate and a state in which the resistance force to operation of the pedal plate is released and the urging force of the urging mechanism is effective.

12 Claims, 7 Drawing Sheets

PEDAL DEVICE

BACKGROUND OF THE INVENTION

The present invention relates to a pedal device capable of maintaining a pedal plate at any position.

In musical instruments that electrically amplify sound by means of an amplifier, such as electric guitars, foot-operated pedal devices are used so as to adjust the sound volume and sound quality even while the performer plays the instrument. Such pedal devices incline a pedal plate so as to adjust the sound volume and sound quality in accordance with the angle of the plate.

For example, Japanese Laid-Open Patent Publication No. 8-202363 describes a device that changes the sound volume of an instrument in accordance with the angle of a pedal plate. In this device, in order to change the sound volume of the instrument continually during a performance, a spring urges the pedal plate to move opposite the direction in which the pedal plate is depressed. Since the pedal plate automatically returns to its initial position if the foot is removed from the pedal plate, the performer does not have to do anything to return the pedal plate to the initial position.

Japanese Utility Model Publication No. 6-025897 describes a device that uses friction force to hold a pedal plate at an angle to which the sound volume has been adjusted. With such a pedal device, once the sound volume has been adjusted, the performer may remove his or her foot from the pedal plate to play the musical instrument.

Conventionally, performers have used these two types of pedal devices for different purposes. However, when both types of pedal devices are necessary, the preparation of a multiple number of pedal devices becomes burdensome.

SUMMARY OF THE INVENTION

It is an object of the present invention to provide a pedal device capable of selecting between a function for maintaining the pedal plate at a certain position after the pedal plate has been depressed and a function for automatically releasing the depressed pedal plate to return the pedal plate to its initial position.

To achieve the above object, the present invention provides a pedal device for use by an operator. The pedal device includes a base. A pedal plate is supported by the base in an inclinable manner and depressible in a depression direction by the operator. An urging mechanism applies an urging force urging the pedal plate in a direction opposite to the depression direction. A force release mechanism releases the pedal plate from the urging force applied by the urging mechanism. A holding mechanism switches the pedal plate between a state in which the pedal plate is held in an operable manner by applying a frictional resistance force resisting operation of the pedal plate and a state in which the frictional resistance force to operation of the pedal plate is released and the urging force of the urging mechanism is applied to the pedal plate.

Other aspects and advantages of the invention will become apparent from the following description, taken in conjunction with the accompanying drawings illustrating by way of example the principles of the invention.

BRIEF DESCRIPTION OF THE DRAWINGS

The invention, together with the objects and advantages thereof, may best be understood by reference to the following description of the presently preferred embodiments together with the accompanying drawings, in which:

FIG. 11(*b*) is a perspective view showing the external appearance of the pedal device of FIG. 11(*a*);

FIG. 12(*b*) is a cross-sectional view showing the depressed portion of the pedal device of FIG. 11(*a*) at a predetermined position.

DETAILED DESCRIPTION OF THE PREFERRED EMBODIMENTS

A pedal device 11 according to a first embodiment of the present invention that is connected to an electric guitar and used to change the sound volume of the electric guitar will now be described with reference to FIGS. 1 through 10.

Figure 1:
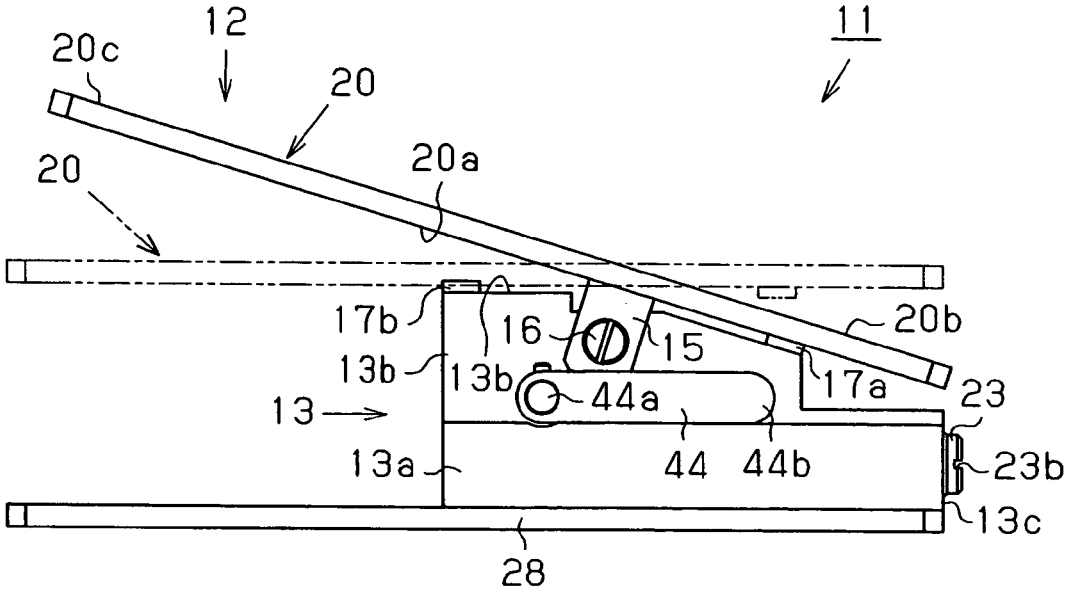
FIG. 1 is a side view showing a pedal device according to a first embodiment of the present invention in a normal state.

As shown in FIG. 1, the pedal device 11 includes a pedal plate 12, which is operated by one foot of the performer's feet, and a base 13 for supporting the pedal plate 12 so that the pedal plate 12 is inclinable. The base 13 includes an urging mechanism 14 (refer to FIG. 4) for separating the distal end of the pedal plate 12 away from the base 13.

Figure 4:
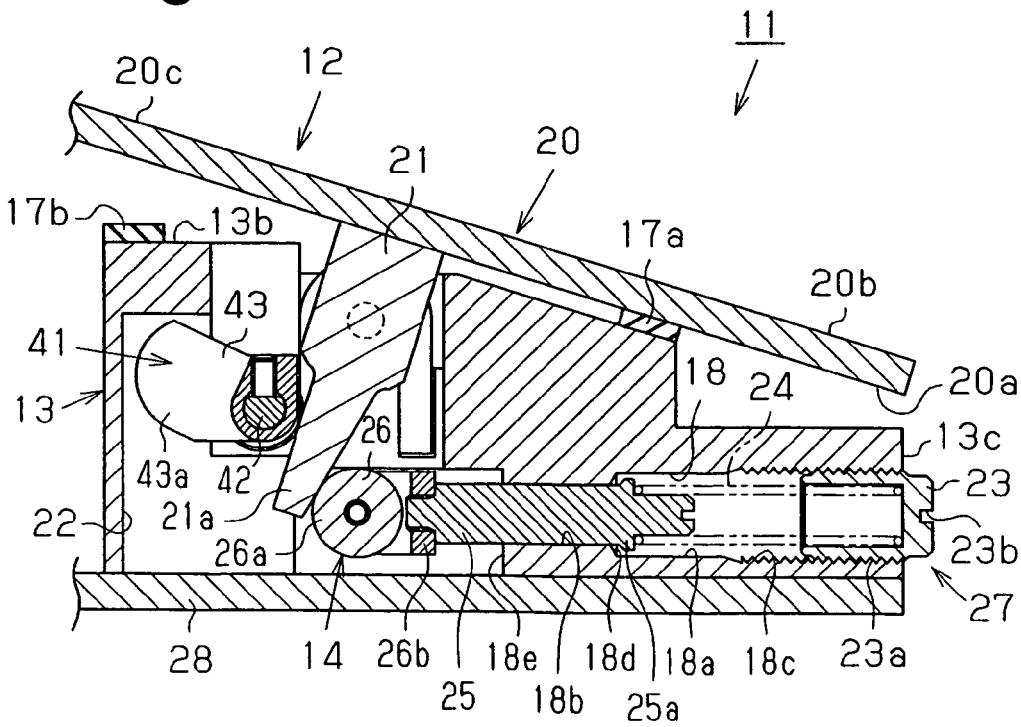
FIG. 4 is an enlarged cross-sectional view taken along line 4-4 of FIG. 3 showing the pedal plate arranged at a standby position when urging force from an urging mechanism is being applied to the pedal plate.

The pedal plate 12 includes an operating plate 20, pedal ribs 15, support shafts 16, and a projection 21 (refer to FIG. 4). The operating plate 20 is operated by one foot of the performer's feet and has a generally rectangular shape. The heel of the performer's foot is placed on the basal portion 20*b* of the operating plate 20, and the toes of the performer's foot is placed on the distal portion 20*c* of the operating plate 20. When the pedal device 11 is not operated by the performer, that is, when the pedal device 11 is in a non-operating state, the force of the urging mechanism 14 arranges the basal portion 20*b* of the operating plate 20 at a position that is lower than the distal portion 20*c* of the operating plate 20, or adjacent to the base 13.

Furthermore, as shown in FIG. 1, a back bumper 17*a*, formed of rubber, is arranged on the lower surface 20*a* of the operating plate 20 at the basal portion 20*b*. In the non-operating state of the pedal plate 12, the force of the urging mechanism 14 moves the basal portion 20*b* downward to contact the base 13 by way of the back bumper 17*a*. In this state, the pedal plate 12 supports the base 13. A bumper 17*b*, formed of rubber, is arranged on an upper block 13*b* of the base 13 in correspondence with the distal portion 20*c* of the operating plate 20. When the performer depresses the distal portion 20*c* of the pedal plate 12 and moves the distal portion 20*c* downward, the distal portion 20*c* contacts the base 13 by way of the front bumper 17*b*. This restricts the inclination of the pedal plate 12. Furthermore, the back bumper 17*a* and the front bumper 17*b* absorb the impact generated when the pedal plate 12 contacts the base 13.

Two pedal ribs 15 protrude downward from the central portion of the operating plate 20 so as to sandwich the upper block 13*b* of the base 13. A support shaft 16 extends horizontally through the central portion of each pedal rib 15.

Each support shaft 16 is formed by a bolt having a cylindrical head and a threaded shaft. Each support shaft 16 is screwed into the associated pedal rib 15 so that the distal end of the support shaft 16 extends toward the base 13. Furthermore, each support shaft 16 may be removed from the pedal rib 15 by rotating the support shaft 16 using a coin or a tool, such as a screwdriver.

The distal end of each support shaft 16 is screwed into the associated pedal rib 15 and is inserted in the upper block 13*b* of the base 13 to pivotally support the pedal plate 12 with the base 13. That is, the pedal plate 12 is inclined between a standby position where the back bumper 17*a* of the pedal plate 12 abuts the upper block 13*b* of the base 13, as shown by the solid line in FIG. 1, and a maximum depression position where the pedal plate 12 abuts the front bumper 17*b* on the upper block 13*b* of the base 13.

As shown in FIG. 4, the projection 21 is plate-like and attached to the operating plate 20 in a manner extending perpendicular to the lower surface 20*a* of the operating plate 20 toward the base 13. A receptacle 22 for receiving the projection 21 is formed in the base 13. Furthermore, the upper block 13*b* of the base 13 positioned above the receptacle 22 does not interfere with the projection 21 and forms a horizontal ceiling. A base plate 28 that is connected with the lower surface of the base 13 forms the bottom surface of the receptacle 22.

Figure 5:
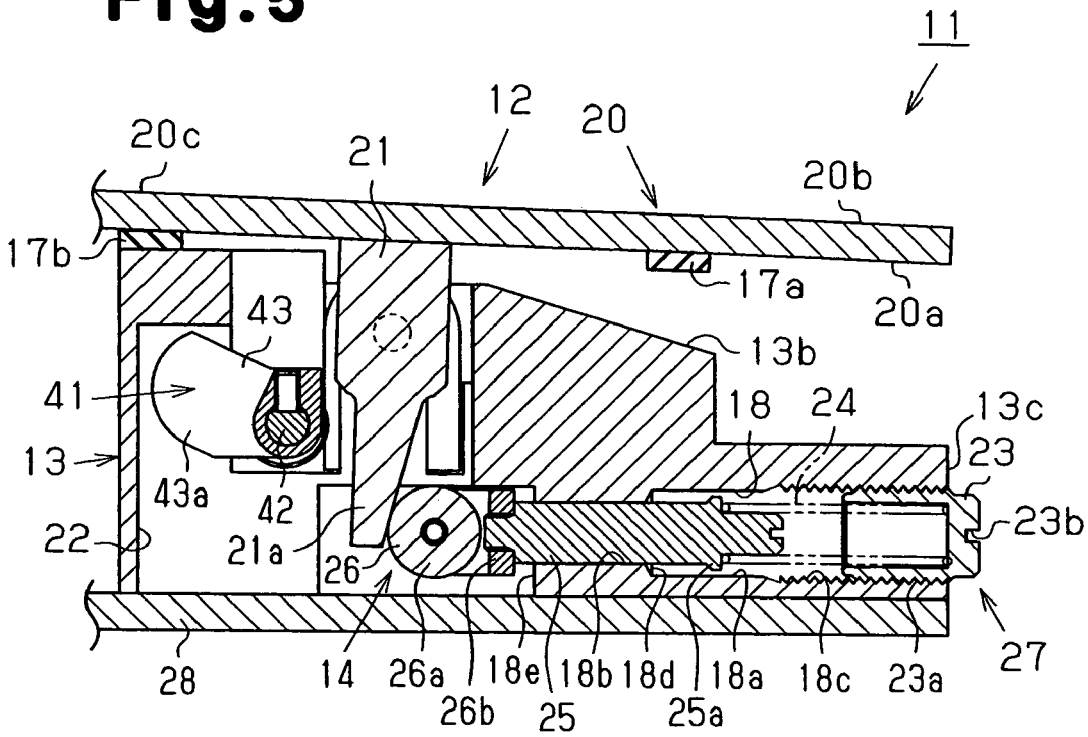
FIG. 5 is an enlarged cross-sectional view showing the pedal plate arranged at a maximum depression angle when the urging force from the urging mechanism is being applied to the pedal plate.

The receptacle 22 has enough space to enable the projection 21 to be inclined freely within the base 13 in accordance with the inclination of the pedal plate 12, as shown in FIGS. 4 and 5. The urging mechanism 14 urges an urged portion 21*a*, defined at the distal portion of the projection 21, toward the distal end of the pedal plate 12. The urging force applied to the projection 21 by the urging mechanism 14 or the depression force applied by a foot to the pedal plate 12 inclines the projection 21 in the receptacle 22.

The urging mechanism 14 located adjacent to the projection 21, as shown in FIGS. 4 and 5. The urging mechanism 14 includes a cap 23, a resilient member 24, a connecting rod 25, and a pressing member 26.

A through-hole 18, which has a circular cross section, is formed on the bottom basal end of the base 13. The through-hole 18, which extends horizontally from the basal end 13*c* of the base 13 toward the distal end of the pedal plate 12, is communicated with the receptacle 22. Furthermore, the through-hole 18 includes a large-diameter hole 18*a*, which is located on the basal end side, and a small-diameter hole 18*b*, which is located on the distal end side. The small-diameter hole 18*b* has a diameter that is smaller than that of the large-diameter hole 18*a*. The large-diameter hole 18*a* includes a female threaded portion 18*c*. The large-diameter hole 18*a* is communicated with the receptacle 22 through the small-diameter hole 18*b*.

The cap 23 is cylindrical and has a closed basal end and an opened distal end. A slot 23*b* is formed in the external surface of the cap 23 that is engaged with a tool, such as a screwdriver. A male threaded portion 23*a* is formed on the outer surface of the cap 23. The male threaded portion 23*a* of the cap 23 is engaged with the female threaded portion 18*c*, and the cap 23 is rotatable with respect to the base 13.

The connecting rod 25 is inserted in the small-diameter hole 18*b* in a movable manner extending from the large-diameter hole 18*a* to the receptacle 22. A flange 25*a* extends radially from the basal end of the connecting rod 25. The flange 25*a* has a diameter that is larger than the small-diameter hole 18*b*. The flange 25*a* comes into contact with a stopper surface 18*d*, which is defined between the large-diameter hole 18*a* and the small-diameter hole 18*b*. Furthermore, a resilient member 24, which is a coil spring, is arranged at the basal end of the connecting rod 25. The basal end of the resilient member 24 is accommodated within the cap 23 and abuts the closed end of the cap 23.

The pressing member 26 is arranged in front of the connecting rod 25. The pressing member 26 includes a roller 26*a* and a support 26*b*, which rotatably supports the roller 26*a*. The support 26*b* is fixed to the distal end of the connecting rod 25 and comes into contact with a stopper surface 18*e*, which is defined between the small-diameter hole 18*b* and the receptacle 22 to restrict further movement of the connecting rod 25.

The roller 26*a* moves toward or away from the urged portion 21*a* of the projection 21. When the roller 26*a* abuts the urged portion 21*a*, the resilient member 24 urges the urged portion 21*a* of the projection 21 forward with the connecting rod 25 and the pressing member 26. Accordingly, the urging mechanism 14 applies a force on the pedal plate 12 in a direction opposite to the depression direction of the pedal plate 12, or toward a standby position.

Furthermore, the cap 23 is rotated to adjust the amount of engagement between the female threaded portion 18*c* and male threaded portion 23*a* and move the cap 23 forward or rearward. When the cap 23 is moved forward, the resilient force of the resilient member 24 increases, and the force applied to the pedal plate 12 by the urging mechanism 14 increases.

When the cap 23 is moved rearward, the resilient force of the resilient member 24 decreases, and the force applied to the pedal plate 12 by the urging mechanism 14 decreases. That is, in the first embodiment, the through-hole 18 and the cap 23 form an adjustment mechanism 27 for adjusting the force applied to the pedal plate 12 by the urging mechanism 14. The adjustment mechanism 27 adjusts the amount of engagement between the female threaded portion 18*c* and the male threaded portion 23*a* to regulate the force applied to the pedal plate 12 by the urging mechanism 14 on the pedal plate 12. That is, by rotating the cap 23 with a coin or a tool, such as a screwdriver, the adjustment mechanism 27 adjusts the force applied to the pedal plate 12 by the urging mechanism 14.

As shown in FIGS. 4 and 5, a release mechanism 41 is arranged in front of the projection 21 in the receptacle 22. The release mechanism 41, the projection 21, the urging mechanism 14, and the adjustment mechanism 27 are arranged in series in the longitudinal direction of the base 13.

The release mechanism 41 includes a first pivot portion 42 and a contact portion 43. The first pivot portion 42 is shaft-like and extends in the lateral direction of the base 13. The two ends of the first pivot portion 42 are rotatably supported by the base 13 and extend outward from the base 13.

Figure 2:
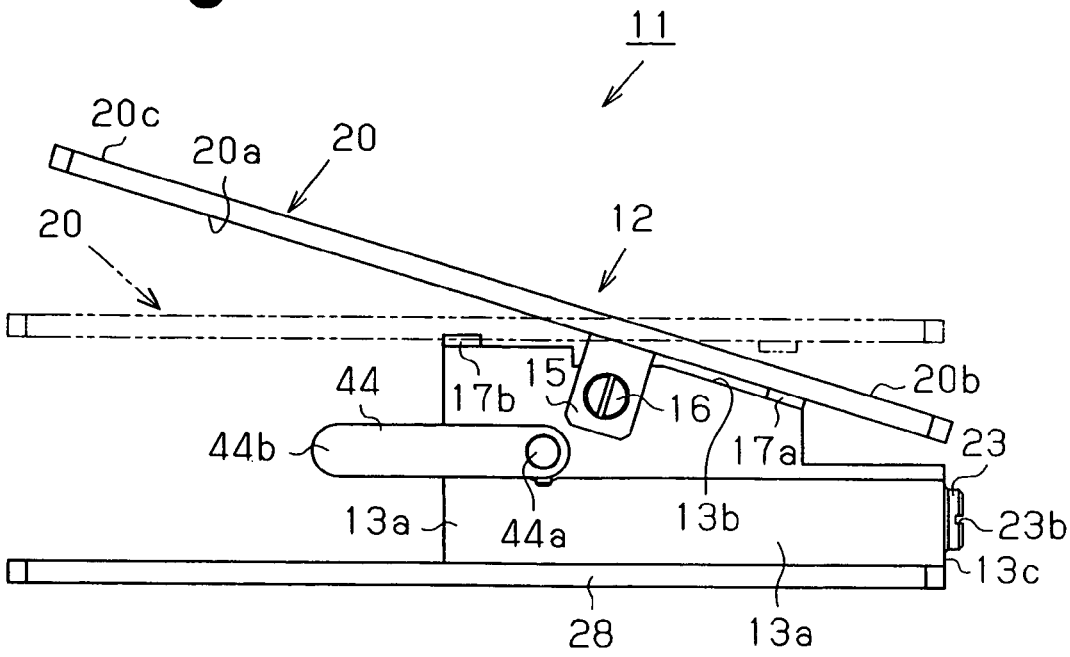
FIG. 2 is a side view showing the pedal device in a holding position.
Figure 3:
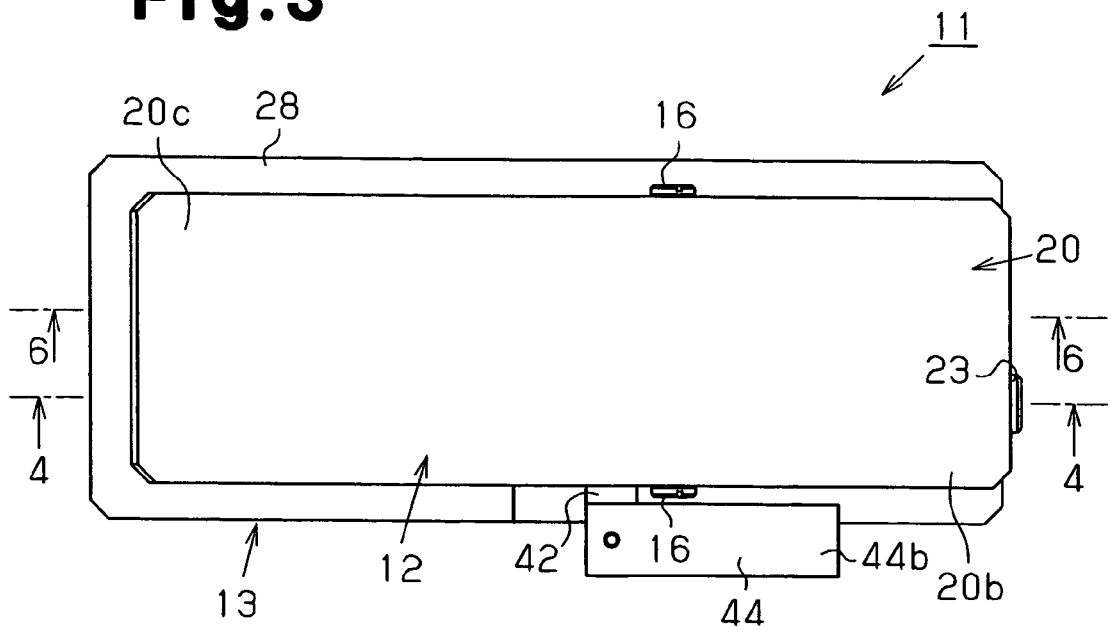
FIG. 3 is a plan view of the pedal device of FIG. 1.

As shown in FIGS. 1 through 3, a lever 44, which is manually rotated by the performer, is fixed to one of the ends of the first pivot portion 42 extending outward from the base 13. The lever 44 extends parallel to the side surface 13*a* of the base 13 from a fixed portion 44*a* of the first pivot portion 42.

The base 13 extends laterally below the lever 44 and in contact with the lever 44. Accordingly, the lever 44 has a distal portion 44*b* that abuts the base 13. The distal portion 44*b* pivots within a range of 180 degrees between a first position, which is shown in the state of FIG. 1, and a second position, which is shown in the state of FIG. 2. The distal portion 44*b* is directed toward the rear at the first position and directed toward the front at the second position. That is, the lever 44 is pivoted above the base 13 in a counter-clockwise direction from the first position to the second position and in a clockwise direction from the second position to the first position.

As shown in FIGS. 4, 5, 7, and 8, the contact portion 43 is formed on the outer surface of the first pivot portion 42. The contact portion 43 includes two plate-like contacts 43*a* extending radially from the first pivot portion 42. Each contact 43*a* rotates integrally with the first pivot portion 42. Both contacts 43*a* are arranged on opposite sides of the projection 21 parallel to and facing toward each other. Thus, when pivoted, the contacts 43*a* do not interfere with the projection 21.

Each contact 43*a* first abuts the roller 26*a* when pivoted from the position shown in FIG. 4 in a predetermined direction (counter-clockwise in the first embodiment). When further pivoted in the same direction, each contact 43*a* presses the roller 26*a* toward the basal end of the base 13 and separates the roller 26*a* from the projection 21. The contact portion 43 counters the force applied by the urging mechanism 14 and holds the pressing member 26 at a predetermined position with the roller 26*a*.

When the performer rotates the lever 44 to push the pressing member 26 with the contact portion 43, the release mechanism 41 releases the force applied to the pedal plate 12 by the urging mechanism 14 by separating the pressing member 26 from the projection 21. The release mechanism 41 separates the contact portion 43 from the pressing member 26 so that the force applied by the urging mechanism 14 becomes effective. In the normal state, the pressing member 26 is engaged with the projection 21 with the urging force of the urging mechanism 14 applied to the projection 21.

When the pedal plate 12 is released from the urging force applied by the urging mechanism 14, the pedal plate 12 is maintained in an operable manner at a predetermined position by means of the friction force produced between the support shafts 16 and the pedal ribs 15 when the pedal plate 12 is inclined relative to the base 13. This state is referred to as the holding state of the pedal plate 12. Furthermore, when the lever 44 is rotated in a clockwise direction from the second position to the first position, the contacts 43*a* are separated from the pressing member 26. Thus, the pressing member 26 again applies a force to the projection 21.

Figure 6:
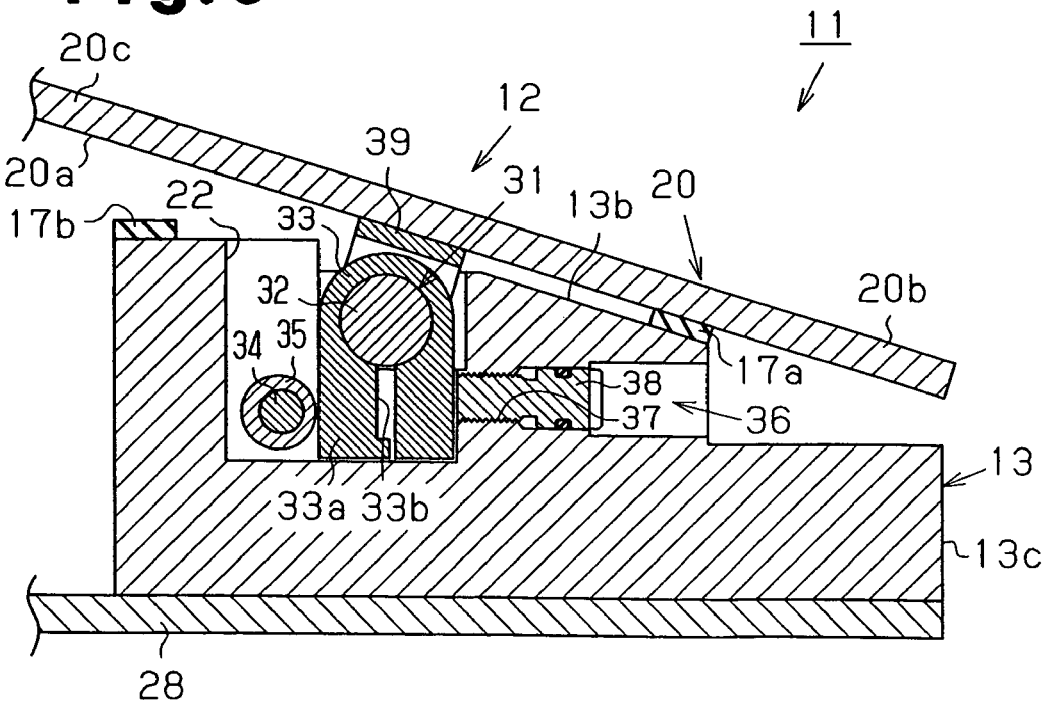
FIG. 6 is an enlarged cross-sectional view taken along line 6-6 in FIG. 3.
Figure 7:
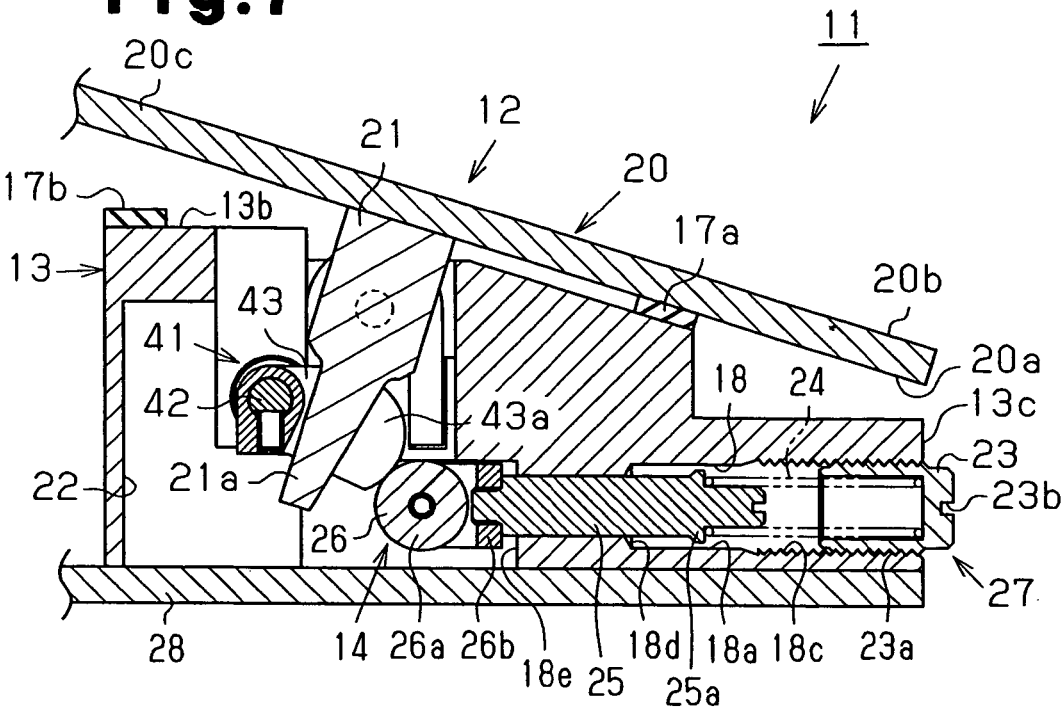
FIG. 7 is an enlarged cross-sectional view showing the pedal plate arranged at a standby position when the urging force from the urging mechanism is not being applied to the pedal plate.
Figure 8:
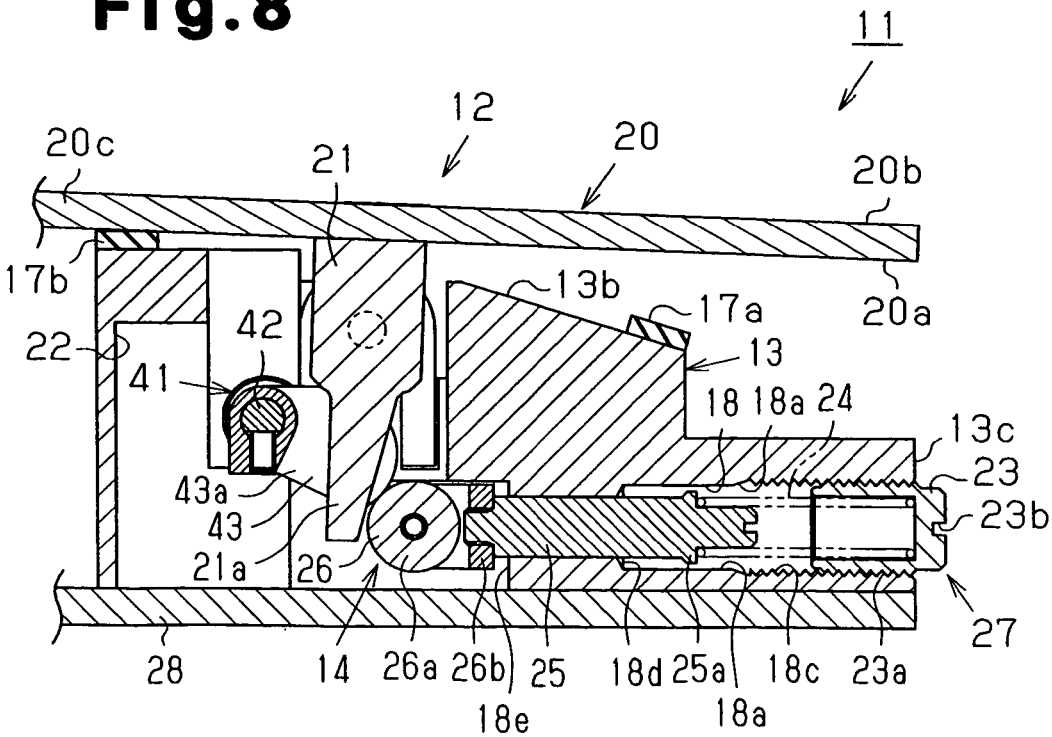
FIG. 8 is an enlarged cross-sectional view showing the pedal plate arranged at a maximum depression position when urging force from the urging mechanism is not being applied to the pedal plate.
Figure 9:
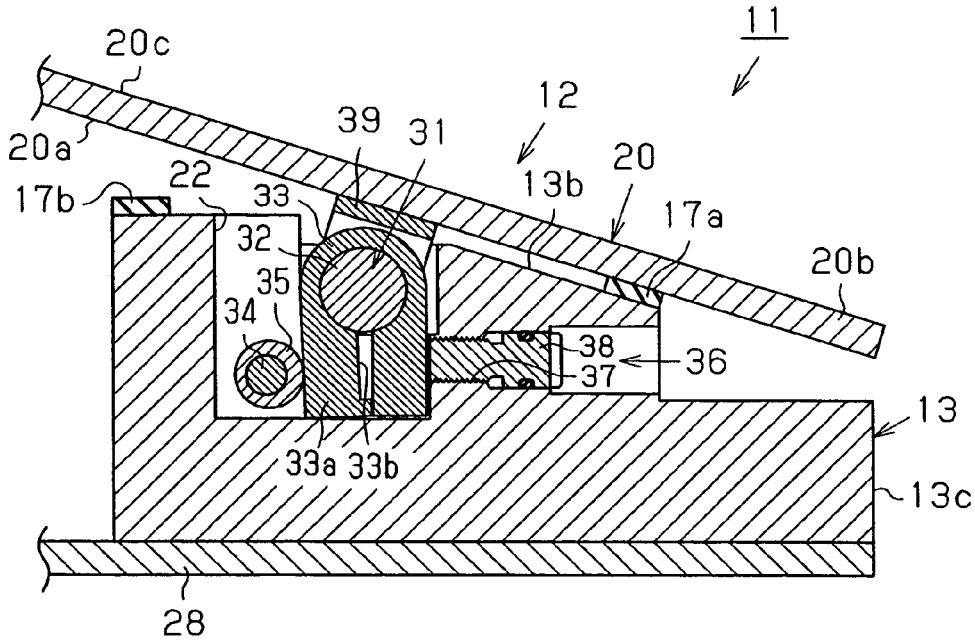
FIG. 9 is an enlarged cross-sectional view showing the pedal plate in a state held by a holding mechanism.

The force release mechanism 41, the projection 21, the urging mechanism 14, and the force adjustment mechanism 27 are longitudinally arranged in series in the receptacle 22. FIGS. 6 and 9 show a holding mechanism 31 and friction force adjustment mechanism 36 arranged in series along a different line.

Figure 10:
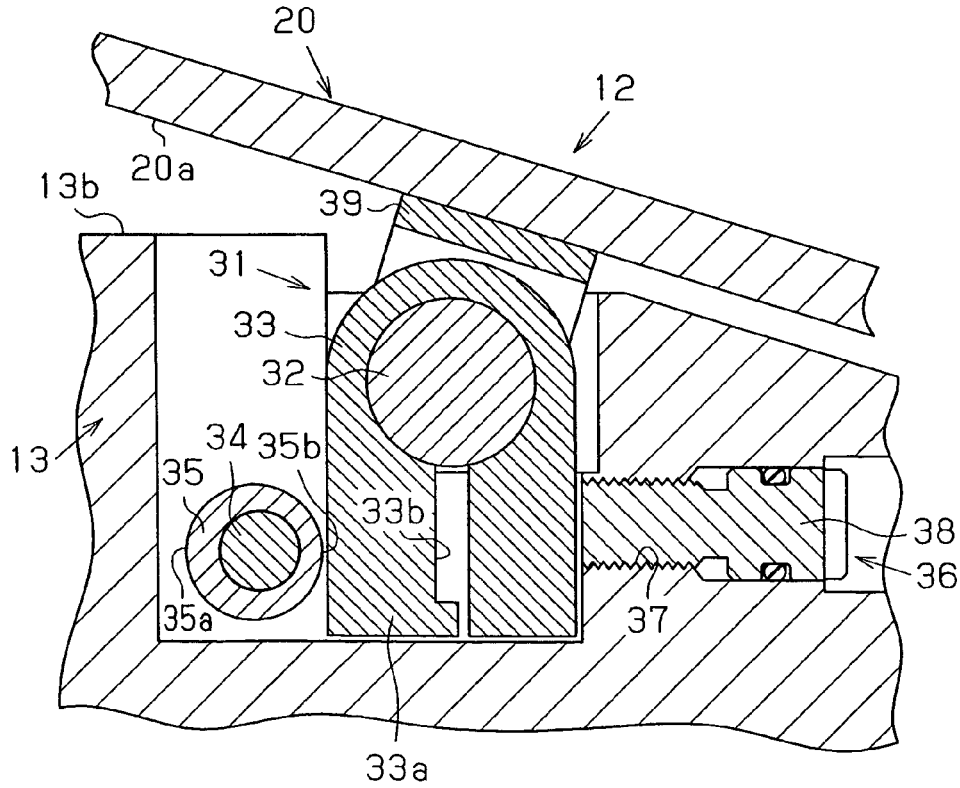
FIG. 10 is an enlarged cross-sectional view showing the pedal plate when released from the held state.

As shown in FIGS. 6, 9, and 10, the holding mechanism 31 includes a held portion 32, a holder 33, which holds the held portion 32, a second pivot portion 34, and a pressing portion 35. The held portion 32 is located at the distal end of a plate-like connector 39, which extends from the lower surface 20*a* of the operating plate 20 into the receptacle 22. The held portion 32, which is coaxial with the support shafts 16, is cylindrical and has a diameter that is larger than the support shafts 16. Accordingly, the held portion 32 rotates about the axis of the support shafts 16 integrally with the inclination of the pedal plate 12.

The holder 33 has a reversed U-shaped cross section and is arranged so that the curvature of its upper part covers the exterior surface of the held portion 32. The holder 33 includes two clamping portions 33*a* extending vertically and facing one another to form a gap 33*b* in between. The upper part of the holder 33 is fitted to the held portion 32 such that the clamping portions 33*a* of the holder 33 extend downward from the held portion 32.

The holder 33 clamps the held portion 32 with the clamping portions 33*a* so as to narrow the gap 33*b*. The holder 33 clamps the held portion 32 with a predetermined friction force that allows the holder 33 to rotate relative to the held portion 32. That is, the friction force between the held portion 32 and the holder 33 is such that the pedal plate 12 is operable relative to the base 13. The friction force also functions as a resistance force that resists the depression of the pedal plate 12. If a force greater than the resistance force depresses the pedal plate 12, the pedal plate 12 is inclined. The clamping of the held portion 32 with the holder 33 is easier than clamping the support shafts 16 because the held portion 32 has a diameter that is greater than that of the support shafts 16.

The axis of the shaft-like second pivot portion 34, which is located in front of the holder 33, extends in the lateral direction of the base 13. In the first embodiment, the second pivot portion 34 is formed integrally with the first pivot portion 42 and is connected to the lever 44 by the first pivot portion 42. Accordingly, when the performer pivots the lever 44, the first pivot portion 42 and the second pivot portion 34 are pivoted together.

The pressing portion 35, which covers the exterior surface of the second pivot portion 34, is generally cylindrical and functions as an eccentric cam that is eccentric relative to the axis of the second pivot portion 34. The pressing portion 35 rotates integrally with the second pivot portion 34. As shown in FIG. 10, the point on the pressing portion 35 at which the distance from the axis of the second pivot portion 34 to the exterior surface of the pressing portion 35 is maximum is referred to as the maximum lift point 35*a*, and the point on the pressing portion 35 at which the distance is minimum is referred to as the minimum lift point 35*b*.

In the normal state of the pedal plate 12 in which the force applied to the pedal plate 12 by the urging mechanism 14 is effective, the minimum lift point 35*b* of the pressing portion 35 is located near the holder 33 but does not contact the holder 33, as shown in the state of FIGS. 6 and 10. Therefore, the friction force between the held portion 32 and the holder 33 is minimal in the normal state. The urging mechanism 14 sets the friction force between the held portion 32 and the holder 33 in the normal state so that movement of the pedal plate 12 to the non-operating state in which the pedal plate 12 is supported on the base 13 by means of the bumpers 17*a*.

As the performer pivots the lever 44 from the first position, the pressing portion 35 first contacts the holder 33 and gradually increases the force that presses the holder 33 to produce friction force between the held portion 32 and the holder 33. Then, as shown in the state of FIG. 9, the friction force between the held portion 32 and the holder 33 becomes maximum when the maximum lift point 35*a* of the pressing portion 35 contacts the holder 33.

In the holding state of the pedal plate 12, the friction force between the held portion 32 and the holder 33 holds the pedal plate 12 at a predetermined position when the pedal plate 12 is not depressed. In this state, the friction force also allows movement of the pedal plate 12 when the performer depresses the pedal plate 12. That is, the pivoting of the second pivot portion 34 results in the holding mechanism 31 producing a predetermined friction force between the held portion 32 and the holder 33 that holds the pedal plate 12 or releases the pedal plate 12 so that the pedal plate 12 is movable relative to the base 13.

The friction force adjustment mechanism 36 that adjusts resistance relative to the inclination of the pedal plate 12, or friction, is formed on the base 13 behind the holding mechanism 31. The friction force adjustment mechanism 36 is provided with a threaded hole 37 and a screw 38 screwed into the threaded hole 37. The threaded hole 37 extends horizontally from near the basal end of the base 13 to the holder 33. A tool, such as a screwdriver, engages a slot formed in the basal end of the screw 38 to rotate the screw 38. The rotation of the screw 38 adjusts the amount of engagement with the threaded hole 37 as it moves forward and rearward longitudinally in the base 13.

The friction force adjustment mechanism 36 contacts the holder 33 and pushes the holder 33 as the screw 38 moves toward the distal end of the base 13. That is, the friction force adjustment mechanism 36 adjusts the clamping force of the holder 33 with the held portion 32 by adjusting the amount of engagement between the screw 38 and the threaded hole 37.

This pedal device 11 may be for an electric guitar, an effector, an amplifier, and the like.

The pedal device 11 includes a known angle sensor. The angle sensor is provided with a digital circuit such as an encoder to detect the inclination angle of the pedal device 11. If the angle sensor detects the inclination angle of the pedal device 11, the angle sensor may be, for example, an analog type sensor including a variable resistor for changing the resistance value relative to the inclination angle.

The angle sensor is connected to a predetermined electric circuit, and is used to change the output signal of the electric circuit based on the input from the sensor. Electric circuits of this type are not limited to so-called effectors, and also include sound sources, such as synthesizers, and simple electrical circuits that change the sound volume via the input from the pedal device 11. The electric circuit may alter a single parameter of sound, or a plurality of parameters. Furthermore, these electric circuits may be integrated with the pedal device 11 or may be separate from the pedal device. When the pedal device 11 and the electric circuit are integrated, the pedal device 11 may be used in a state connected between an amplifier and a musical instrument or in a state connected only to an amplifier. When the pedal device 11 and the electric circuit are separated, the pedal device 11 may be connected to the electric circuit and the electric circuit may further be connected between an amplifier and a musical instrument or only to an amplifier. Although the first embodiment has been described only in terms of adjusting sound volume, the device also may be used for adjusting sound quality in the normal state and sound volume in the holding state.

The operation of the pedal device 11 will now be described. The performer may wish to play an electric guitar while continually adjusting the volume of the electric guitar. In this case, the pedal device 11 is operated so that when the pedal plate 12 is depressed and then released, the pedal automatically and quickly returns to its original position. That is, the lever 44 is set at the first position shown in the state of FIG. 1.

When the lever 44 is set at the first position, the contact portion 43 is separated from the pressing member 26, and the pressing member 26 engages the projection 21, as shown in the state of FIG. 4. Thus, the urging mechanism 14 applies urging force to the projection 21. Therefore, when the pedal plate 12 is not depressed, the back bumper 17*a* at the basal portion 20*b* of the pedal plate 12 contacts the base 13 so that the base 13 supports the pedal plate 12, as shown in FIG. 4. In this state, when the performer depresses the distal portion 20*c* of the pedal plate 12 against the force applied by the urging mechanism 14, a signal is output from the angle sensor through the electric circuit to the amplifier in accordance with the angle of the inclination of the pedal plate 12. This changes the sound volume of the electric guitar. That is, the volume of the electric guitar is adjusted to a desired volume by depressing the distal portion 20*c* of the pedal plate 12. Then, the volume of the electric guitar is increased in accordance with the amount of depression of the pedal plate 12 and becomes maximum when the lower surface of the pedal plate 12 at the distal portion 20*c* contacts the front bumper 17*b*, as shown in FIG. 5.

During a performance, when returning the volume to the original level, the performer stops depressing the pedal plate 12. This results in the force of the urging mechanism 14 inclining the pedal plate 12 in a direction opposite to the depression direction even if the performer does not return the pedal plate 12 by depressing the basal portion 20*b* of the pedal plate 12. The volume of the electric guitar decreases in accordance with the inclination angle of the pedal plate 12.

When playing the guitar at a constant volume over a certain time in a state in which the force of the urging mechanism 14 is effective, the performer must play the guitar while keeping the pedal plate 12 depressed at a certain position with a foot, against the force of the urging mechanism 14. Alternatively, if the pedal plate 12 is held at a predetermined position without depressing the pedal plate 12 with one foot, it would become easier for the performer to play the guitar.

In such a case, the performer rotates the lever 44 from the first position shown in the state of FIG. 1 to the second position shown in the state of FIG. 2. The first pivot portion 42 and the second pivot portion 34 are rotated integrally with the lever 44.

The rotation of the first pivot portion 42 rotates the contacts 43*a* in the counter-clockwise direction on both sides of the projection 21 until contacting the roller 26*a* of the urging mechanism 14. In this state, the roller 26*a* continues to urge the pedal plate 12 via the projection 21.

When the contacts 43*a* are further rotated against the force of the roller 26*a*, the contacts 43*a* push and move the roller 26*a* rearward. As a result, the roller 26*a* is separated from the projection 21 and releases the pedal plate 12 from the urging force of the urging mechanism 14. When the contacts 43*a* are rotated to the position shown in FIG. 7, the contacts 43*a* maintain this state against the urging force of the roller 26*a*. In this state, the lever 44 is at the second position shown in FIG. 2, and further rotation is restricted. Accordingly, when the lever 44 is set at the second position, the pedal plate 12 is released from the urging force of the urging mechanism 14. When the performer removes his or her foot from the pedal plate 12, the pedal plate 12 remains still and does not incline in the direction opposite to the depression direction.

As shown in FIGS. 6 and 9, the pressing portion 35 rotates integrally with the second pivot portion 34. When the lever 44 is set at the first position, the minimum lift point 35*b* of the pressing portion 35 is adjacent to the holder 33, as shown in FIG. 10. From this state, as the performer rotates the lever 44 toward the second position in the counterclockwise direction, the pressing portion 35 contacts the holder 33 and gradually presses the holder 33 rearward. That is, the rotation of the pressing portion 35 causes the holder 33 to clamp the held portion 32 to narrow the width of the gap 33*b* and change the friction force between the held portion 32 and the holder 33. The pressing portion 35 contacts the holder 33 at the maximum lift point 35*a*, that is, the pressing portion 35 rotates until the pedal plate 12 enters the holding state, as shown in FIG. 9. When the pedal plate 12 enters the holding state, the friction force between the held portion 32 and the holder 33 is maximum, and further rotation of the lever 44 is restricted.

When the pedal plate 12 is in the holding state, the performer depresses the pedal plate 12 against the friction force between the held portion 32 and the holder 33 to change the volume of the electric guitar. When a desirable volume for the electric guitar is obtained, the performer stops depressing the pedal plate 12. Then, the pedal plate 12 is maintained at this position by the friction force between the held portion 32 and the holder 33. Thus, the performer may continue to play the guitar without operating the pedal plate 12.

When the pedal plate 12 is in the holding state and the performer again wants to play the electric guitar while continuously adjusting the volume of the guitar, the performer rotates the lever 44 in the clockwise direction of FIG. 2 to switch the lever 44 from the second position to the first position. This rotates the first pivot portion 42 and the second pivot portion 34 in the same direction.

The contacts 43*a* are rotated to the position shown in FIG. 4 when the first pivot portion 42 is rotated in the clockwise direction. This separates the contacts 43*a* from the roller 26*a*. Then, the urging force of the resilient member 24 moves the roller 26*a* forward until the roller 26*a* engages the projection 21. Accordingly, the urging force of the urging mechanism 14 acts on the pedal plate 12.

Furthermore, when the second pivot portion 34 is rotated in the clockwise direction, the pressing portion 35 is rotated from where the maximum lift point 35*a* contacts the holder 33 to where the minimum lift point 35*b* faces toward the holder 33. As the pressing portion 35 rotates, the pushing force applied to the holder 33 gradually decreases. When the minimum lift point 35*b* faces toward the holder 33, the friction force between the held portion 32 and the holder 33 becomes minimum.

To adjust the force applied to the pedal plate 12 by the urging mechanism 14 when operating the pedal plate 12, the performer rotates the cap 23 with a tool, such as a screwdriver, and adjusts the amount of engagement of the female threaded portion 18*c* and the male threaded portion 23*a* in the adjustment mechanism 27. When the rotation of the cap 23 moves the cap 23 inward in the base 13, the force applied to the pedal plate 12 by the urging mechanism 14 increases. Conversely, when the cap 23 is moved outward from the base 13, the force applied to the pedal plate 12 by the urging mechanism 14 decreases.

To adjust the friction force between the holder 33 and the held portion 32 when operating the pedal plate 12, the performer rotates the screw 38 of the friction force adjustment mechanism 36 with a tool, such as a screwdriver, to adjust the amount of engagement between the screw 38 and the threaded hole 37. When the screw 38 is moved forward and pressed against the holder 33, the friction force between the held portion 32 and the holder 33 is increased. Conversely, when the screw 38 is moved rearward, the friction force between the held portion 32 and the holder 33 is decreased.

The first embodiment has the advantages described below.

(1) In the present embodiment, the performer chooses whether or not to maintain the pedal plate 12 at a certain position relative to the base 13 by rotating the lever 44.

(2) The friction force adjustment mechanism 36 enables the performer to set the friction force to a desired level when inclining the pedal plate 12.

(3) The adjustment mechanism 27 enables the performer to set the urging force of the urging mechanism 14 for inclining the pedal plate 12 to a desired level.

A second embodiment according to the present invention will now be described with reference to FIGS. 11(*a*), 11(*b*), 12(*a*), and 12(*b*). To avoid redundancy, like or same reference numerals are given to those components that are the same as the corresponding components of the first embodiment. The description centers on parts differing from the first embodiment.

A pedal device 111 of the second embodiment includes a pedal plate 112 operated by the foot of the performer, and a base 113, which supports the pedal plate 12 in an inclinable manner. The pedal plate 112 includes a pushed portion 52. Similar to the first embodiment, the pedal device 111 is switched between a normal state, in which the urging force of an urging mechanism 114 is effective, and a holding state, in which a holding mechanism 131 holds the pedal plate 112 at a certain position. That is, when the pedal device 111 is in the holding state, the holding mechanism 131, which is arranged on the base 113, maintains the operating degree of the pedal plate 112, as shown in the state of FIG. 12(*a*).

The pedal plate 112 has a basal end 120*b*. An operation piece 51 is arranged at the central portion of the basal end 120*b* on the lower surface 120*a* of the pedal plate 112. A metal fitting (not shown) supports the operation piece 51 so that the operation piece 51 is movable in the longitudinal direction of an operating plate 120.

Figure 12A:
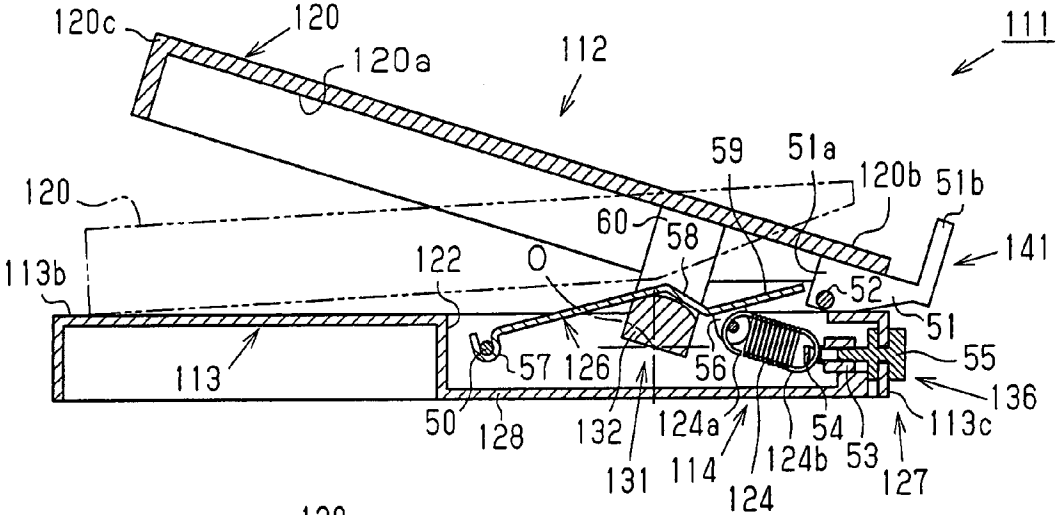
FIG. 12(*a*) is a cross-sectional view showing a depressed portion of the pedal device at a release position.
Figure 12B:
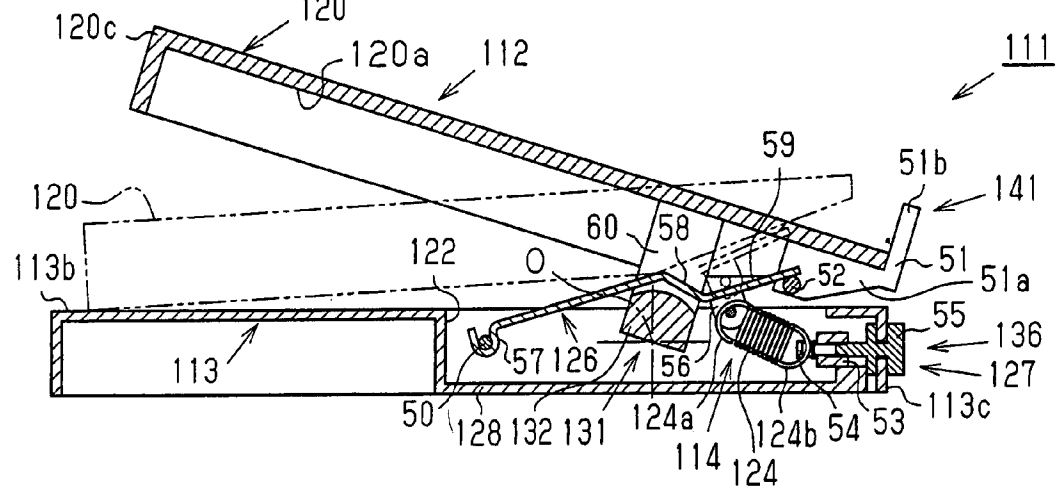

The operation piece 51 has two side surfaces 51*a* extending parallel to the side surface 113*a* of the base 113 and includes the pushed portion 52, which is pin-like and protrudes leftward from the left side surface 51*a* (as viewed in FIG. 12). The pushed portion 52 moves in the longitudinal direction of the operating plate 120 when the operation piece 51 is moved.

A projection 51*b* is formed at the basal end of the operation piece 51. The projection 51*b* extends rearward from the basal end of the operating plate 120 and is bent upward so that it projects upward from the top surface of the pedal plate 112. Accordingly, the performer can easily operate the operation piece 51 using the projection 51*b* with the heel of his or her foot.

The pedal plate 112 is provided with an extension 60 and a held portion 132, as shown in FIG. 12(*a*). The extension 60 extends from the lower surface 120*a* of the operating plate 120 toward the base 113, and the held portion 132 is provided on the distal end of the extension 60.

Figure 11:
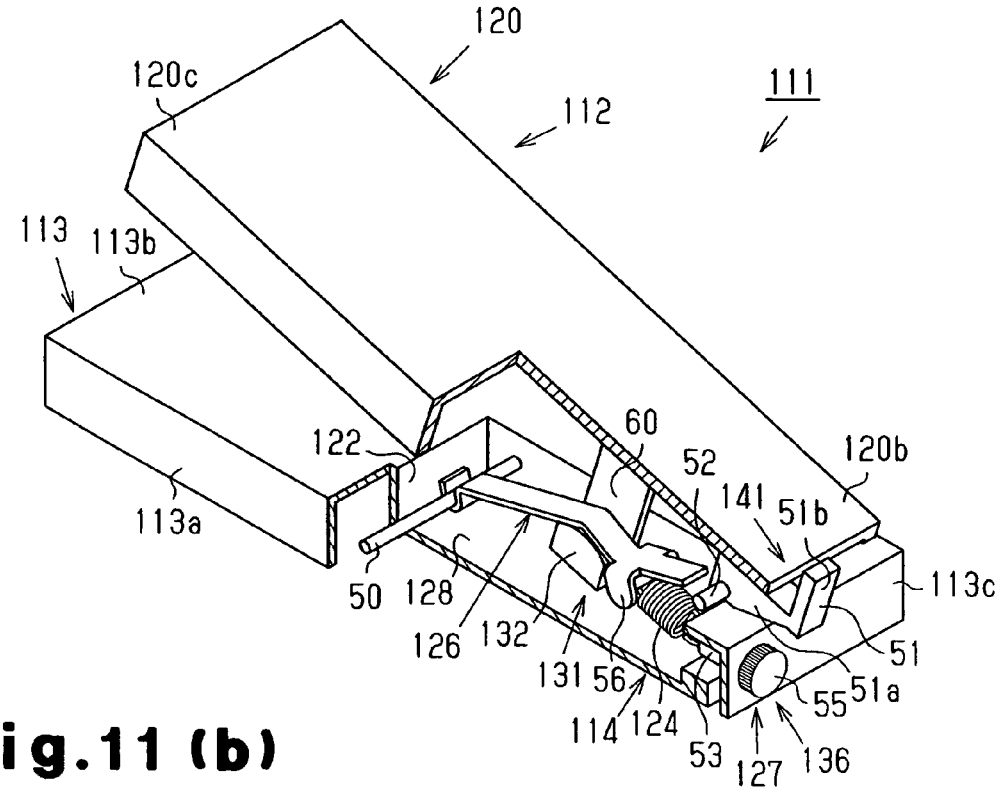
FIG. 11(*a*) is a partially cutaway perspective view showing a pedal device according to a second embodiment of the present invention.
Figure 11:
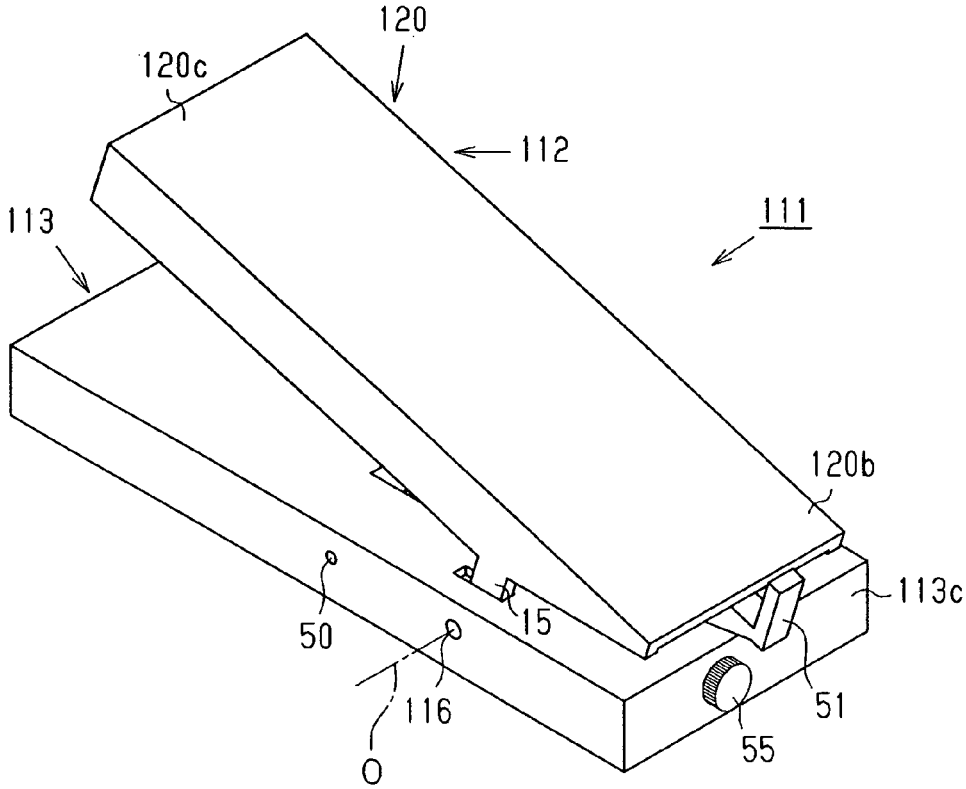

As shown in FIGS. 11(*a*) and 12(*a*), the base 113 includes a receptacle 122, which is opened upward and located in the laterally middle portion of the base 113 between the central portion and the basal wall 113*c* of the base 113. An adjustment screw 55 extending from the basal wall 113*c* toward into the receptacle 122 is rotatably inserted in the base 113. A male thread is formed on the distal end of the adjustment screw 55. Furthermore, the basal end of the adjustment screw 55 is cylindrical and has a diameter that is larger than the diameter of the distal end of the adjustment screw 55. A groove extends along the basal end of the adjustment screw 55. The groove is fitted to a basal wall 113*c* to rotatably support the adjustment screw 55 with the basal wall 113*c*.

A box-like adjustor 53 is screwed on to the tip of the adjustment screw 55. A C-shaped hook 54 is formed on the distal end of the adjustor 53. Furthermore, the lower surface of the adjustor 53 abuts a bottom plate 12.8 of the base 113. Therefore, rotation of the adjustor 53 around the axis of the adjustment screw 55 is restricted. The amount of engagement of the adjustor 53 and the adjustment screw 55 is adjusted by rotating the adjustment screw 55. This moves the adjustment screw 55 forward and rearward.

The holding mechanism 131 is arranged in the receptacle 122. The holding mechanism 131 includes a resilient member 124, a pressing member 126, and the held portion 132.

The resilient member 124 is a coil spring. Semicircular fasteners 124*a* and 124*b* are formed on the two ends of the resilient member 124. The basal end fastener 124*b* is anchored to the hook 54 of the adjustor 53. The distal end fastener 124*a* is connected to the pressing member 126.

The pressing member 126 is an elongated plate. The distal portion 57 of the pressing member 126 occupies approximately half the pressing member 126. The distal portion 57 includes an inclined surface rising upward toward the rear at an angle of approximately 20-30 degrees. The distal end of the distal portion 57 is U-shaped so as to form a channel. A laterally extending rod 50 is fixed to the base 113. The channel receives the rod 50 to support the pressing member 126 so as to be inclinable relative to the base 113. A bent portion 58 extends continuously from the distal portion 57 at the middle of the pressing member 126. The bent portion 58 is inclined downward toward the rear. Furthermore, a basal portion 59 extends continuously from the bent portion 58. The basal portion 59 is inclined upward toward the rear.

A holding member 56 is provided on the basal portion 59 of the pressing member 126. The holding member 56 includes two holding pieces, each bent downward from one of the two sides of the basal portion 59. A shaft extends between the two holding pieces.

The distal end fastener 124*a* of the resilient member 124 is connected to the shaft of the holding member 56. Accordingly, the urging force of the resilient member 124 inclines the pressing member 126 downward about the rod 50.

As shown in FIG. 12(*a*), an extension 60 provided on the pedal plate 112 extends perpendicular to the lower surface 120*a* of the operating plate 120 so as to intrude into the receptacle 122. The extension 60 is a plate, and a held portion 132 is defined at the distal end of the extension 60 and located under the pressing member 126. The held portion 132 is arranged below the boundary between the distal portion 57 and the bent portion 58 of the pressing member 126. The held portion 132 is arranged substantially above the axis O of a pivot shaft 116 shown in FIGS. 11(*b*), 12(*a*), and 12(*b*). The held portion 132 inclines when the pedal plate 112 inclines. The upper surface of the held portion 132 is round and lies along a cylindrical surface having an axis that coincides with the axis O. Accordingly, the upper surface of the held portion 132 lies along the cylindrical surface and the positional relationship between the upper surface and the axis O does not change even if the pedal plate 112 is inclined.

In the holding state of the pedal plate 112 shown in FIGS. 11(*a*) and 12(*a*), the held portion 132 abuts the flat parts on the lower surfaces of the bent portion 58 and distal portion 57. In this manner, a predetermined friction force is produced between the held portion 132 and the pressing member 126. The pressing member 126 restricts the inclination of the pedal plate 112 with the friction force but holds the pedal plate 112 so that it is still operable.

Referring to FIGS. 12(*a*) and 12(*b*), the basal portion 59 of the pressing member 126 in the holding state may be pushed from below by the pushed portion 52 by moving the operation piece 51. That is, movement of the operation piece 51 moves the pushed portion 52 between a rearward release position, at which the pushed portion 52 does not interfere with the pressing member 126, and an engage position, at which the pushed portion 52 pushes the pressing member 126 from below. When the pushed portion 52 is moved from the release position to the engage position, the basal portion 59 of the pressing member 126 is pushed from below, as shown in FIG. 12(*b*). Then, the pressing member 126 is pivoted about the rod 50 and inclined upward to separate the pressing member 126 from the held portion 132. This eliminates friction between the held portion 132 and the pressing member 126 and releases the pedal plate 112 from the holding state.

As shown in FIG. 12(*b*), the resilient member 124 urges the pressing member 126 downward even when the pressing member 126 is pivoted about the rod 50 and inclined upward by the pushed portion 52. As a result, the basal end 120*b* of the pedal plate 112 is forced downward because the pressing member 126 forces the pushed portion 52, which is located at an engaged position, downward. The urging mechanism 114 of the second embodiment includes the resilient member 124 and the pressing member 126 and forces the basal end of the pedal plate 112 downward with the pressing member 126. In the second embodiment, the resilient member 124 and the pressing member 126 are included in both the urging mechanism 114 and holding mechanism 131. Furthermore, the pedal device 111 of the second embodiment switches the pedal plate 112 between a holding state and a normal state by moving the operation piece 51.

As indicated by the solid lines in FIG. 12(*b*), when the pedal plate 112 is in the normal state and not depressed, the urging force of the pressing member 126 holds the pedal plate 112 at a predetermined standby position. In this state, the basal end 120*b* is lower than the distal end 120*c*. As indicated by the broken line in FIG. 12(*b*), when the performer depresses the distal end 120*c* of the operating plate 120 of the pedal plate 112, the pedal plate 112 inclines until the distal end 120*c* abuts the upper surface 113*b* of the base 113. Furthermore, when the performer stops depressing the pedal plate 112, the urging force of the urging mechanism 114 returns the pedal plate 112 to the standby position.

When the pedal plate 112 is in the normal state, the amount of engagement of the adjustment screw 55 relative to the adjustor 53 is adjusted to move the adjustor 53 rearward. This increases the urging force of the resilient member 124 applied to the pressing member 126. Thus, the urging force of the urging mechanism 114 applied to the pedal plate 112 increases. When the adjustor 53 is moved forward, the urging force of the urging mechanism 114 is decreased. In the second embodiment, the force adjustment mechanism 127 includes the adjustor 53 and the adjustment screw 55.

When the operation piece 51 is moved from the engaged position shown in FIG. 12(*b*) to the release position shown in FIG. 12(*a*), the pedal plate 112 is switched from the normal state to the holding state. In the second embodiment, the force release mechanism 141 includes the operation piece 51. The performer moves the operation piece 51 and separates the pushed portion 52 from the pressing member 126 to release the pedal plate 112 from the urging force of the urging mechanism 114.

In the holding state of the pedal plate 112, when the adjustor 53 is moved rearward by the adjustment screw 55, the urging force of the resilient member 124 applied to the pressing member 126 is increased. This increases the pressing force applied to the held portion 132 by the pressing member 126. However, when the adjustor 53 is moved forward, the pressing force is decreased. More specifically, in the second embodiment, the friction force adjustment mechanism 136, which includes the adjustor 53 and the adjustment screw 55, adjusts the amount of engagement of the adjustment screw 55 relative to the adjustor 53 to adjust the friction force between the pressing member 126 and the held portion 132. Accordingly, in the second embodiment, the force adjustment mechanism 127 is also used as the friction force adjustment mechanism 136.

The operation of the pedal device 111 will now be described.

When the performer wants to operate the pedal device 111 in the normal state in which the urging force is applied to the pedal plate 112, the operation piece 51 is pushed forward and the pushed portion 52 is arranged below the pressing member 126, as shown in FIG. 12(*b*). This moves the pedal plate 112 to the standby position at which the distal end 120*c* is separated from and located above the base 113, as indicated by the solid lines in FIG. 12(*b*). From this state, when the performer depresses the distal end 120*c* of the operating plate 120, the distal end 120*c* of the operating plate 120 moves downward and the pedal plate 112 is inclined. When the performer stops depressing the distal end 120*c*, the urging force of the urging mechanism 114 returns the pedal plate 112 to the standby position. In the normal state in which the urging force is applied to the pedal plate 112, the performer must use his or her foot to continue to hold the pedal plate 112 against the urging force of the urging mechanism 114 when the performer wants to maintain the pedal plate 112 at a certain position.

When the performer wants to operate the pedal device 111 in the holding state of the pedal plate 112, the operation piece 51 is pulled rearward to arrange the pushed portion 52 at the release position, as shown in FIG. 12(*a*). Thus, the pushed portion 52 is separated from the pressing member 126, and the pedal device 111 is switched from the normal state to the holding state. Simultaneously, the downward urging force of the resilient member 124 abuts the pressing member 126 against the held portion 132. This holds the pedal plate 112 in an operable manner, and the pedal device 111 enters the holding state.

In the holding state, the performer depresses the pedal plate 112 against the friction force between the pressing member 126 and the held portion 132 to incline the pedal plate 112. Furthermore, the pedal plate 112 is maintained at a depressed position even when the performer stops depressing the plate 112.

When the pedal plate 112 is switched again from the holding state to the normal state, the performer presses the basal end 120*b* of the pedal plate 112 downward with his or her heel. Then, the performer pushes the operation piece 51 forward to arrange the pushed portion 52 at the engage position, as shown in FIG. 12(*b*). Thus, the pedal device 111 is again switched to the normal state.

When the performer wants to increase the urging force applied to the pedal plate 112 in the normal state or when the performer wants to increase the holding force applied to the pedal plate 112 in the holding state, the performer turns the adjustment screw 55 in the clockwise direction. To decrease these forces, the performer turns the adjustment screw 55 in the counterclockwise direction.

In addition to advantages (1), (2), and (3) of the first embodiment, the second embodiment has the advantages described below.

(4) The pedal device 111 employs the pressing member 126. This enables the reduction of two components from the first embodiment, the contact portion 43 and the holder 33. Therefore, fewer parts are used in the pedal device 111 and the cost is reduced.

(5) In the second embodiment, the resilient member 124, which forms part of the urging mechanism 114, also forms part of the holding mechanism 131. Accordingly, since there is no need to provide a component used only to hold the held portion 132 with a predetermined friction force as in the case of the pressing portion 35 in the first embodiment, fewer components are used in the pedal device 111 and the cost is reduced.

(6) In the second embodiment, the force adjustment mechanism 127 is also used as the friction force adjustment mechanism 136. Accordingly, the force adjustment mechanism 127 and friction force adjustment mechanism 136 do not have to be formed by different components as in the first embodiment. Thus, fewer components are used in the pedal device 111 and the cost is reduced.

It should be apparent to those skilled in the art that the present invention may be embodied in many other specific forms without departing from the spirit or scope of the invention. Particularly, it should be understood that the present invention may be embodied in the following forms.

The first embodiment includes the force release mechanism 41, the holding mechanism 31, the friction force adjustment mechanism 36, and the force adjustment mechanism 27. However, the friction force adjustment mechanism 36 and the force adjustment mechanism 27 may be omitted. Further, in the second embodiment, the friction force adjustment mechanism 136 and the force adjustment mechanism 127 may be omitted. Such structures would still have advantage (1) of the first embodiment.

In the first embodiment, the force release mechanism 41 abuts against the pressing member 26 of the urging mechanism 14 to release the pedal plate 112 from the urging force of the urging mechanism 14. However, the force release mechanism 41 may directly abut against the resilient member 24 to release the pedal plate from the urging force.

In the first embodiment, the contact portion 43 is provided with two plate contacts 43*a*. However, any number of contacts 43*a* may be provided. Furthermore, the contacts 43*a* need not be plate-like.

In the first embodiment, the pedal plate 12 is held at a predetermined position in a manner operable relative to the base 13 by the friction force between the held portion 32 and the holder 33. The pedal plate 12 may also be held at the predetermined position by the friction force produced between the support shaft 16 and the shaft bearing.

In the first embodiment, the held portion 32 is cylindrical. However, the held portion 32 may have any form as long as the friction force between the held portion 32 and the holder 33 may be varied.

In the first embodiment, the outer surface of the held portion 32 is clamped. However, opposite sides of the held portion 32 may be clamped.

In the first embodiment, the friction force adjustment mechanism 36 adjusts the friction force between the held portion 32 and the holder 33. However, the friction force adjustment mechanism 36 may also adjust the friction force between the support shaft 16 and a bearing of the support shaft 16.

In the first embodiment, the pressing member 26 includes the roller 26*a*. However, any component may be used in lieu of the roller 26*a* as long as it can urge the projection 21.

In the second embodiment, the operation piece 51 is arranged on the pedal plate 112. However, the operation piece 51 may be arranged on the base 113. More specifically, the moveable pushed portion 52 may be provided on the pedal plate 112 and the movable operation piece 51 may be provided on the base 113 so that the performer operates the operation piece 51 to move the pushed portion 52.

In the first embodiment, the performer operates the lever 44 with his or her hand. However, the performer may use his or her foot to operate the lever 44. Furthermore, in the second embodiment, the performer operates the operation piece 51 with his or her foot. However, the performer may use his or her hand to operate the operation piece 51.

In each of the above embodiments, the force release mechanisms 41 and 141 release the pedal plates 12 and 112 from the urging force of the pressing members 26 and 126 by moving the contact portion 43 and the pushed portion 52. However, the urging mechanisms 14 and 114 may be moved to release the pedal plates 12 and 112 from the urging forces.

Therefore, the present examples and embodiments are to be considered as illustrative and not restrictive and the invention is not to be limited to the details given herein, but may be modified within the scope and equivalence of the appended claims.

What is claimed is:

1. A pedal device for use by an operator, the pedal device comprising:

a base;

a pedal plate supported by the base in an inclinable manner and depressible in a depression direction by the operator;

an urging mechanism for applying an urging force urging the pedal plate in a direction opposite to the depression direction, the urging mechanism includes a pressing member, which is engaged with and disengaged from the pedal plate, and a resilient member for urging the pedal plate in a predetermined direction with the pressing member when the pressing member is engaged with the pedal plate;

a force release mechanism for releasing the pedal plate from the urging force applied by the urging mechanism; the force release mechanism includes a contact portion for contacting the pressing member, the contact portion contacting the pressing member against the urging force of the resilient member to release the pedal plate from the urging force of the urging mechanism; the force release mechanism includes a first pivot portion pivoted by the operator, and the contact portion contacts the pressing member when the first pivot portion is pivoted;

a holding mechanism for switching the pedal plate between a state in which the pedal plate is held in an operable manner by applying a frictional resistance force resisting operation of the pedal plate and a state in which the frictional resistance force to operation of the pedal plate is released and the urging force of the urging mechanism is applied to the pedal plate; the holding mechanism includes a held portion, integrally pivotable with the pedal plate, and a holder for holding the held portion, and the pedal plate is held in the operable manner when the holder holds the held portion with a predetermined frictional resistance force to apply the frictional resistance force resisting operation of the pedal plate, the held portion is cylindrical and has an axis coinciding with the pivot of axis of the pedal plate, the holder surrounds the outer surface of the held portion and includes a gap, and the holding mechanism further includes a pressing mechanism for pressing the holder to narrow the gap of the holder and for producing the frictional resistance force when the pressing mechanism is operated.

2. The pedal device of claim 1, wherein the holding mechanism includes a second pivot portion pivoted by the operator, the pivoting of the second pivot portion operating the pressing mechanism.

3. The pedal device of claim 2, wherein the pressing mechanism includes an eccentric cam that is eccentrically rotatable relative to the axis of the second pivot portion.

4. The pedal device of claim 2, wherein the first pivot portion and the second pivot portion are formed integrally, and the first pivot portion and the second pivot portion are pivoted integrally to release the pedal plate from the urging force of the force release mechanism and hold the pedal plate in an operable manner or to apply the urging force of the urging mechanism to the pedal plate and release the pedal plate from the holding mechanism.

5. The pedal device of claim 1, wherein the force release mechanism includes: an operation piece moved by the operator between a standby position and an operation position; and a pushed portion defined on the operation piece and moved integrally with the operation portion; and the urging mechanism includes:

a pressing member engaged with and disengaged from the pushed portion; and a resilient member for urging the pressing member in a predetermined direction;

the pushed portion engaging the pressing member when the pushed portion is moved with the operation piece to the operation position at which the resilient member urges the pedal plate in a predetermined direction via the pressing member and the pushed portion; and the pushed portion being disengaged from the pressing member when the pushed portion is moved with the operation piece to the standby position at which the pedal plate is released from the urging force of the resilient member.

6. The pedal device of claim 5, wherein:

the pedal plate includes a held portion integrally pivotable with the pedal plate;

the holding mechanism engaging the pressing member with the held portion when the pushed portion is located at the standby position to hold the pedal plate in an operable manner with frictional resistance force produced between the pressing member and the pushed portion; and the holding mechanism disengaging the pressing member from the held portion when the pushed portion is located at the operation position.

7. The pedal device of claim 1 further comprising:

a friction force adjustment mechanism for adjusting the friction force produced when the pressing mechanism is operated.

8. The pedal device of claim 7, wherein the friction force adjustment mechanism includes a screw that is movable relative to the base, and the screw and the pressing mechanism clamp the holder therebetween to produce the frictional resistance force, with the position of the screw being adjustable to adjust the level of the frictional resistance force.

9. The pedal device of claim 1, further comprising an urging force adjustment mechanism for adjusting the urging force applied to the pedal plate.

10. The pedal device of claim 1, wherein the resilient member is formed by a coil spring, the base includes a through-hole for accommodating the coil spring, a cap is movably screwed into the through-hole, the coil spring is interposed between the pressing member and the cap, and the position of the cap is adjustable to adjust the urging force of the coil spring.

11. The pedal device of claim 1, further comprising: a screw arranged on the base, wherein the position of the screw is adjustable, and the holder is held between the screw and the pressing mechanism to produce the frictional resistance force, the position of the screw being adjusted to adjust the level of the frictional resistance force.

12. The pedal device of claim 1, wherein the frictional resistance force is adjustable.

* * * * *